US009717275B2

(12) United States Patent
Liu

(10) Patent No.: US 9,717,275 B2
(45) Date of Patent: Aug. 1, 2017

(54) ELECTRONIC CIGARETTE PREVENTING ITS NOZZLE FROM FALLING OFF

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 1001 days.

(21) Appl. No.: 13/997,196

(22) PCT Filed: Mar. 5, 2013

(86) PCT No.: PCT/CN2013/072163
§ 371 (c)(1),
(2) Date: Jun. 21, 2013

(87) PCT Pub. No.: WO2014/134779
PCT Pub. Date: Sep. 12, 2014

(65) Prior Publication Data

US 2014/0251325 A1 Sep. 11, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/00–47/008; A61M 15/06; A61M 15/0091; A61M 15/009; A61M 2202/0468
(Continued)

(56) References Cited

U.S. PATENT DOCUMENTS

2005/0247578 A1* 11/2005 Gelardi ..... B65D 15/08 206/1.5
2010/0224633 A1* 9/2010 Gelardi ..... B65D 15/08 220/315

(Continued)

FOREIGN PATENT DOCUMENTS

CN 101843368 A * 9/2010 ..... A24F 47/00
CN 201640873 U * 11/2010 ..... A45F 3/16
CN 201839801 U * 5/2011 ..... A24F 47/00
CN WO 2012129787 A1 * 10/2012 ..... A24F 47/008
CN 203234037 U * 10/2013 ..... A24F 47/00

OTHER PUBLICATIONS

CN201640873U (Machine Translation) [online], [retrieved on Mar. 25, 2016], retrieved from Espacenet (http://worldwide.espacenet.com/?locale=en_EP).*

(Continued)

*Primary Examiner* — Michael H Wilson
*Assistant Examiner* — Yana B Krinker
(74) *Attorney, Agent, or Firm* — Cheng-Ju Chiang

(57) ABSTRACT

The present invention relates to an electronic cigarette preventing its nozzle from falling off, comprising a shell with a hollow inner chamber. The shell is configured with an atomizer, a cylindrical liquid storage component and a storage battery and a cup holder therein, and has its one end to be inserted with a cylindrical nozzle. The nozzle coaxially defines a vent extended therethrough, and is configured with expanding portions at its outer sidewall for tightly engaging with an inner wall of the shell by expansion, the vent is configured with plural reinforcing ribs axially extended on its inner wall and a support tube positioned on its inner wall; the nozzle, the cup holder and a part of the shell collectively form a liquid smoke cup for accommodating and positioning the liquid storage component, and the liquid storage component is configured with a conduit communicated with the vent of the nozzle.

15 Claims, 7 Drawing Sheets

(58) Field of Classification Search
USPC ..... 131/27–273, 194; 128/202.21
See application file for complete search history.

(56) References Cited

U.S. PATENT DOCUMENTS

| | | | | |
|---|---|---|---|---|
| 2011/0303231 | A1* | 12/2011 | Li | A24F 47/008 131/329 |
| 2011/0304282 | A1* | 12/2011 | Li | A24F 47/008 315/362 |
| 2012/0174935 | A1* | 7/2012 | Steinberg | A24F 1/32 131/329 |
| 2012/0312313 | A1* | 12/2012 | Frija | A24F 47/002 131/329 |

OTHER PUBLICATIONS

CN101843368A (Machine Translation) [online], [retrieved on Mar. 25, 2016], retrieved from Espacenet (http://worldwide.espacenet.com/?locale=en_EP).*
CN201839801U (Machine Translation) [online], [retrieved on Mar. 25, 2016], retrieved from Espacenet (http://worldwide.espacenet.com/?locale=en_EP).*
WO2012129787A1 (Machine Translation) [online], [retrieved on Mar. 25, 2016], retrieved from Espacenet (http://worldwide.espacenet.com/?locale=en_EP).*
CN203234037U (Machine Translation) [online], [retrieved on Mar. 25, 2016], retrieved from Espacenet (http://worldwide.espacenet.com/?locale=en_EP).*

* cited by examiner

ELECTRONIC CIGARETTE PREVENTING ITS NOZZLE FROM FALLING OFF

CROSS REFERENCE TO RELATED APPLICATIONS

The present application is a 35 U.S.C. §371 National Phase conversion of International (PCT) Patent Application No. PCT/CN2013/072163, filed on Mar. 5, 2013, the disclosure of which is incorporated by reference herein. The PCT International Patent Application was filed in Chinese.

TECHNICAL FIELD

This invention relates to a field of electronic cigarettes, and particularly to an electronic cigarette preventing its nozzle from falling off.

DESCRIPTION OF BACKGROUND

Current electronic cigarettes comprises a shell and a nozzle insertedly engaged with inner wall of the shell, and they are interferentially engaged with each other, the shell and the nozzle both are made of soft plastic materials, and the nozzle generally has a hollow chamber structure, without support therein. Since the shell adopts soft plastic materials, the shell and the nozzle would be deformed when squeezed by teeth bite during use, and an axial extruding force on the nozzle is larger than a frictional force between the nozzle and the outer shell, resulting in the nozzle is easy to fall off from the shell.

SUMMARY

An object of the present invention is to provide an electronic cigarette preventing its nozzle from falling off, which can prevent the nozzle from falling off from the electronic cigarette.

To achieve the above object, the present invention provides a n electronic cigarette preventing its nozzle from falling off, comprising a shell with a hollow inner chamber, the shell being configured with an atomizer, a cylindrical liquid storage component and a storage battery therein, the shell having its one end to be inserted with a cylindrical nozzle, the nozzle coaxially defining a vent extended therethrough, wherein, the nozzle is configured with expanding portions at its outer sidewall for tightly engaging with an inner wall of the shell by expansion, the vent is configured with plural reinforcing ribs axially extended on its inner wall, the vent is further configured with a support tube inserted into and positioned on its inner wall; the shell is further configured with a cup holder therein for supporting the liquid storage component, the nozzle, the cup holder and a part of the shell collectively form a liquid smoke cup for accommodating and positioning the liquid storage component, the liquid storage component is configured with a conduit on its inner wall for supporting the liquid storage component, the conduit is communicated with the vent of the nozzle.

Wherein, the reinforcing ribs are formed by projecting of the inner wall of the vent toward the axis line, or indenting of the inner wall of the vent departed from the axis line.

Wherein, the plural reinforcing ribs are circumferentially arranged.

Wherein, the reinforcing ribs have curved, conical or trapezoidal cross-sections.

Wherein, the expanding portions are plural protrusions, bumps or expanding rings radially outwardly protruded from the outer sidewall of the nozzle, or plural protrusions, bumps or strip-shaped ribs axially extended along the outer sidewall of the nozzle.

Wherein, the nozzle comprises a tubular main body and a top cover integrally configured at an end portion of the main body, and the expanding portions are configured at an outer sidewall of the main body, the vent is defined in the main body and axially extended through the main body, the top cover coaxially defines an intake communicated with the vent.

Wherein, the top cover is configured with a restraining flange radially outwardly extended therefrom for abutting against an end portion of the shell.

Wherein, the intake has its diameter smaller than an effective diameter of the vent.

Wherein, the support tube has its outer sidewall to abut against the plural reinforcing ribs so as to be tightly engaged with the inner wall of the vent by expansion.

Wherein, the support tube has its opposite ends to be respectively communicated with the conduit and the nozzle.

Wherein, the atomizer comprises a heating wire and a liquid guiding member for absorbing the liquid smoke and supporting the heating wire, the heating wire is wound around the liquid guiding member, the cup holder is a cylindrical cup, and the cup holder comprises an annular sidewall, a round cup bottom, a positioning post coaxially extended from the cup bottom; an annular inner chamber is defined between the annular sidewall and the positioning post for accommodating the liquid storage component; a vent in the cup holder is axially extended through the positioning post and the cup bottom; the cup bottom defines perforations therein extended therethrough for the heating wire 211 to pass through; the cup holder is configured with expanding rings at its annular sidewall for tightly engaging with the shell by expansion, the cup holder is tightly engaged by expansion with the inner wall of the shell through its annular sidewall and the expanding rings; the heating wire has its positive and negative electrodes to pass out of the cup holder respectively and be electrically connected with positive and negative electrodes of the storage battery.

Wherein, the conduit is a hollow round pipe with a central hole, and comprises a top portion and a bottom portion, the top portion thereof abuts against the nozzle, while the bottom portion thereof is sleeved and positioned on the cup holder; the conduit has its central hole to be communicated with the vent of the nozzle and the vent of the cup holder respectively; the conduit defines locking slots extended through its pipe wall for supporting and positioning the liquid guiding member, the liquid guiding member traverses the conduit and has its opposite ends to pass through the locking slots and abut against the liquid storage component to absorb the liquid smoke for atomization by the heating wire.

Wherein, the liquid storage component is a hollow cylindrical structure, and sleeved on an outside of the conduit and tightly engaged with the outer wall of the conduit for support, and has its one end to be inserted into the annular inner chamber of the cup holder, and its another end to abut against the nozzle; the liquid storage component has its inner sidewall to abut against the liquid guiding member.

Wherein, the electronic cigarette is detachable electronic cigarette, and comprises a sucking rod and a power rod connected with each other, the shell of the electronic cigarette is constituted by a casing of the sucking rod and a casing of the power rod, the nozzle is inserted to an inner wall of the casing of the sucking rod; the sucking rod is configured with a first connector at its end engaged with the power rod, the first connector comprises a first seat and a first pole respectively served as two connecting electrodes of the first connector, a first insulating sleeve is configured between the first seat and the first pole for insulation, the first pole is inserted into a central portion of the first seat by means of the first insulating sleeve; the first seat and the first pole are respectively connected with the positive and negative electrodes of the heating wire, the power rod is configured with a second connector at its end engaged with the sucking rod, the second connector comprises a second seat and a second pole respectively served as two connecting electrodes of the second connector, a second insulating sleeve is configured between the second seat and the second pole for insulation, the second pole is inserted into a central portion of the second seat by means of the second insulating sleeve, the storage battery is configured in the power rod, the second seat and the second pole are respectively connected with the positive and negative electrodes of the storage battery; the first seat and the second seat are threadedly connected to make the first seat and the second seat to abut against each other and make the first pole and the second pole to abut against each other.

Wherein, the electronic cigarette is a one-piece electronic cigarette, and its shell is a one-piece shell.

Adopting the above technical solutions, the electronic cigarette preventing its nozzle falling off of the present invention has the following beneficial effects: firstly the nozzle is additionally configured with the expanding portions at its outer sidewall for engaging with the shell, the vent of the nozzle is additionally configured with the plural reinforcing ribs and the support tube on its inner wall, the support tube has its outer sidewall to abut against the plural reinforcing ribs to thereby be positioned in the vent, which can prevent the nozzle from being excessively deformed by external force during being inserted into the shell, and prevent that an axial extruding force on the nozzle is larger than a frictional force between the nozzle and the outer shell, and furthermore effectively prevent the nozzle from falling off from the shell.

The embodiments of the present invention are further described in detail as follows in conjunction with the accompanying drawings.

DETAILED DESCRIPTION OF THE EMBODIMENTS

It should be noted that, the embodiments and the characteristics in the embodiments can be mutually combined in case of no confliction. The present invention would be further described in detail as follows through embodiments in conjunction with the accompanying drawings.

Figure 1:
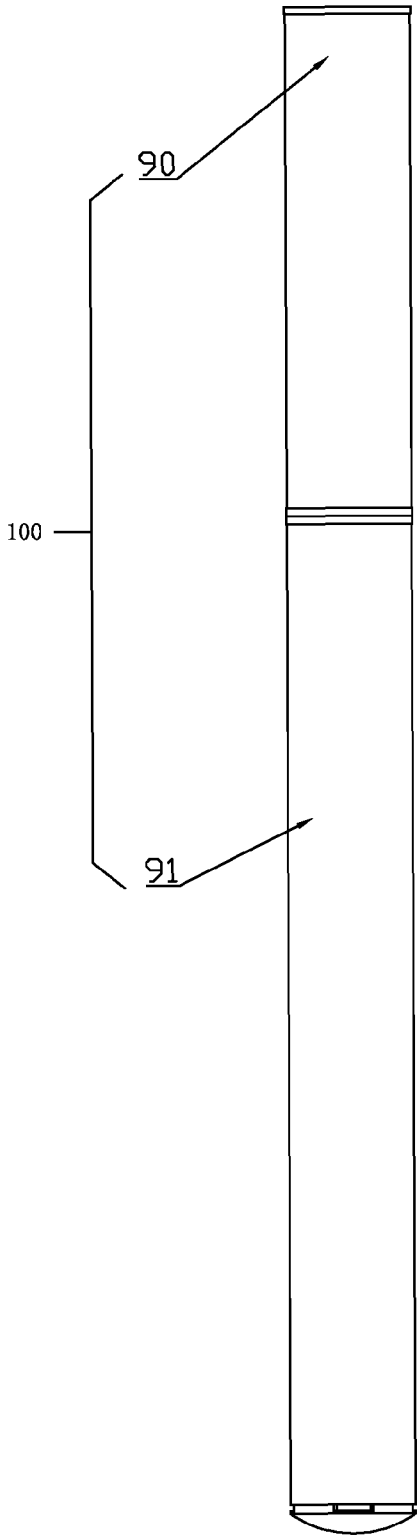
FIG. 1 is a front view of an electronic cigarette in accordance with a first embodiment of the present invention.

As shown from FIG. 1 to FIG. 8, a first embodiment of the present invention provides an electronic cigarette 100, the electronic cigarette 100 is a detachable electronic cigarette, and comprises a sucking rod 90 and a power rod 91, which are connected and combined together by screw threads. The electronic cigarette 100 has its shell constituted by a sucking cylinder 1 as a casing of the sucking rod 90 and a sheath 910 as a casing of the power rod 91 which are described hereafter. The sucking rod 90 is configured with a first connector 5 at its end engaged with the power rod 91, the power rod 91 is configured with a second connector 6 at its end engaged with the sucking rod 90. For easy description, the orientation as shown in FIG. 1 is referenced hereafter in the present embodiment.

Figure 2:
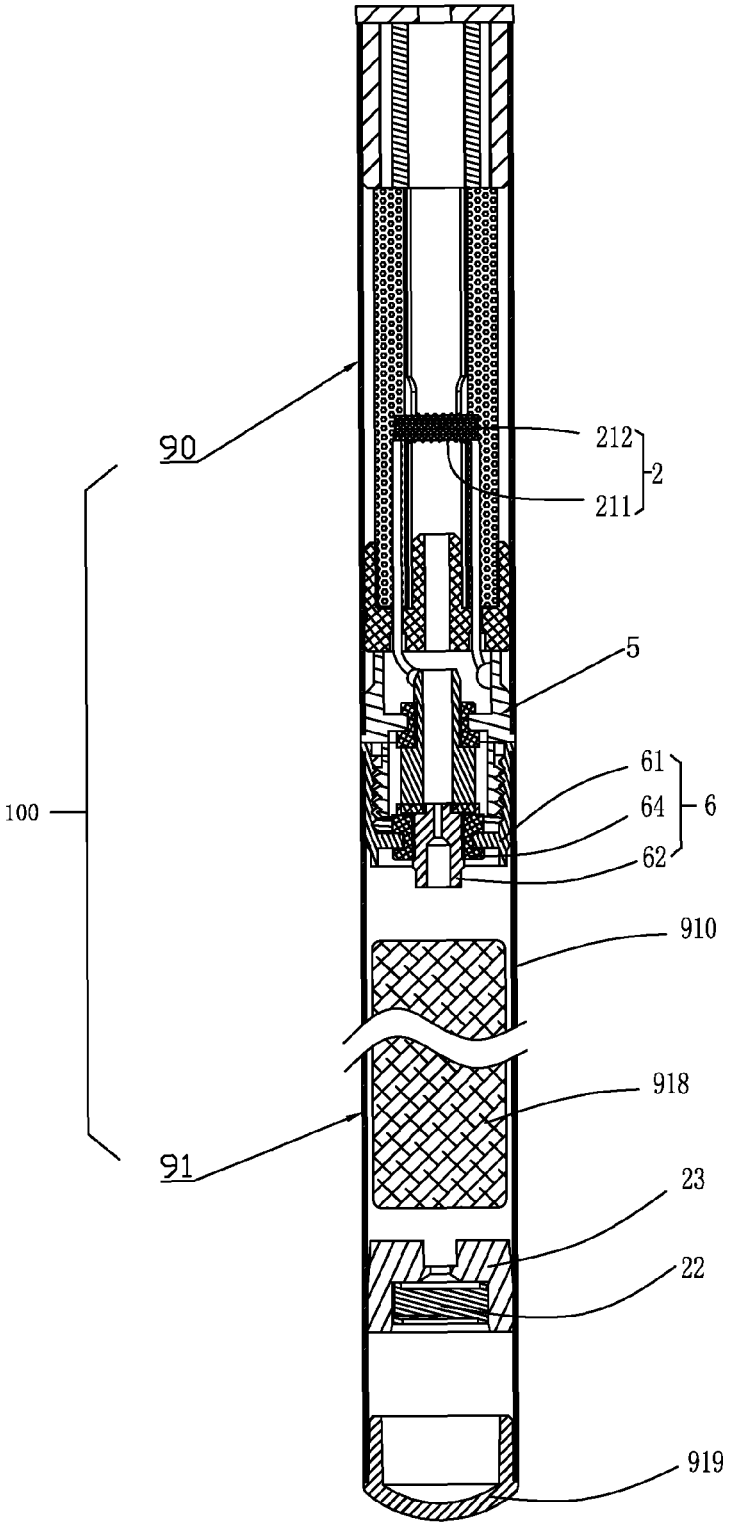
FIG. 2 is a cross-sectional view of the electronic cigarette in accordance with the first embodiment of the present invention.
Figure 3:
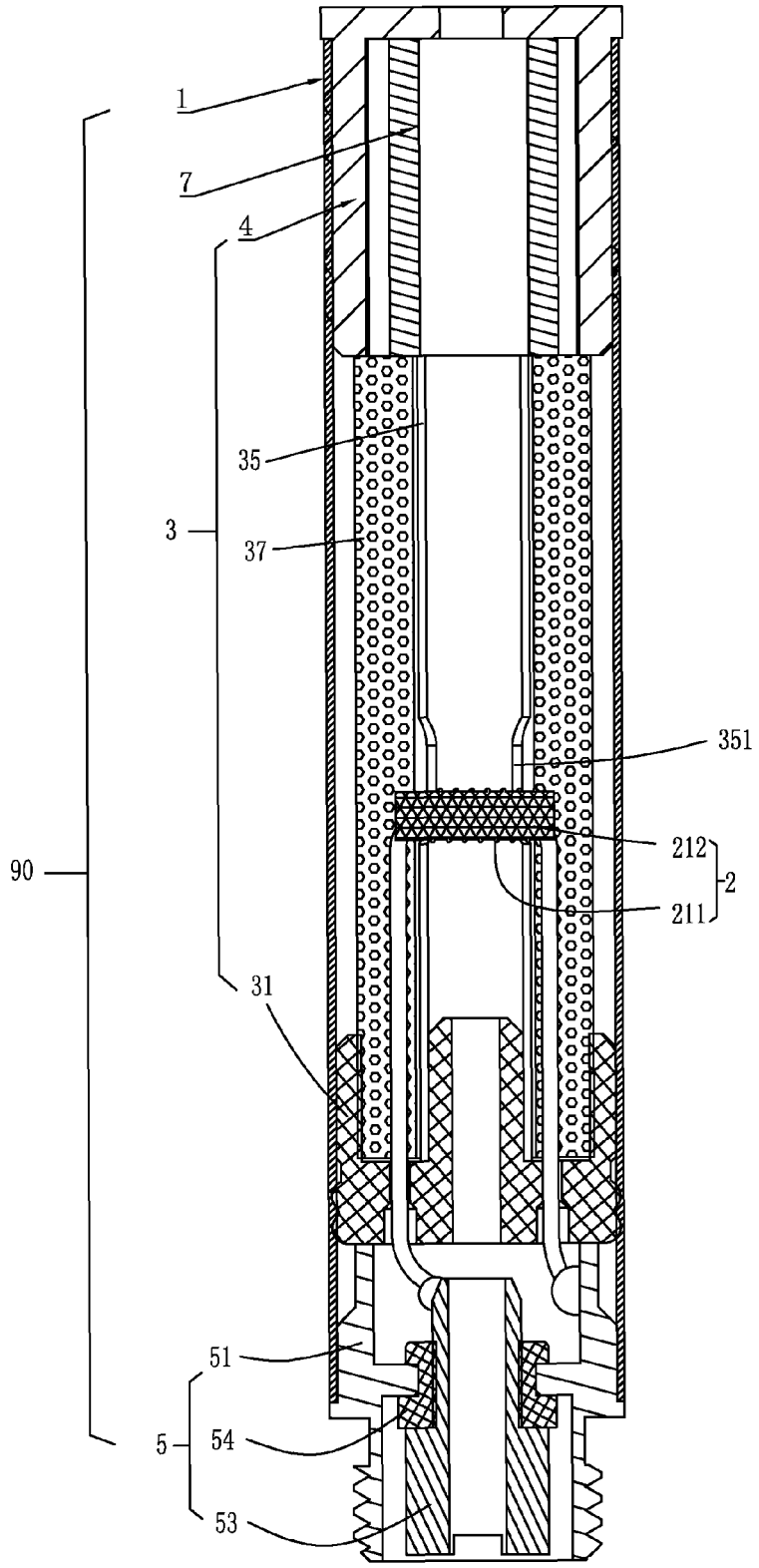
FIG. 3 is a cross-sectional view of a sucking rod of the electronic cigarette in accordance with the first embodiment of the present invention.
Figure 4:
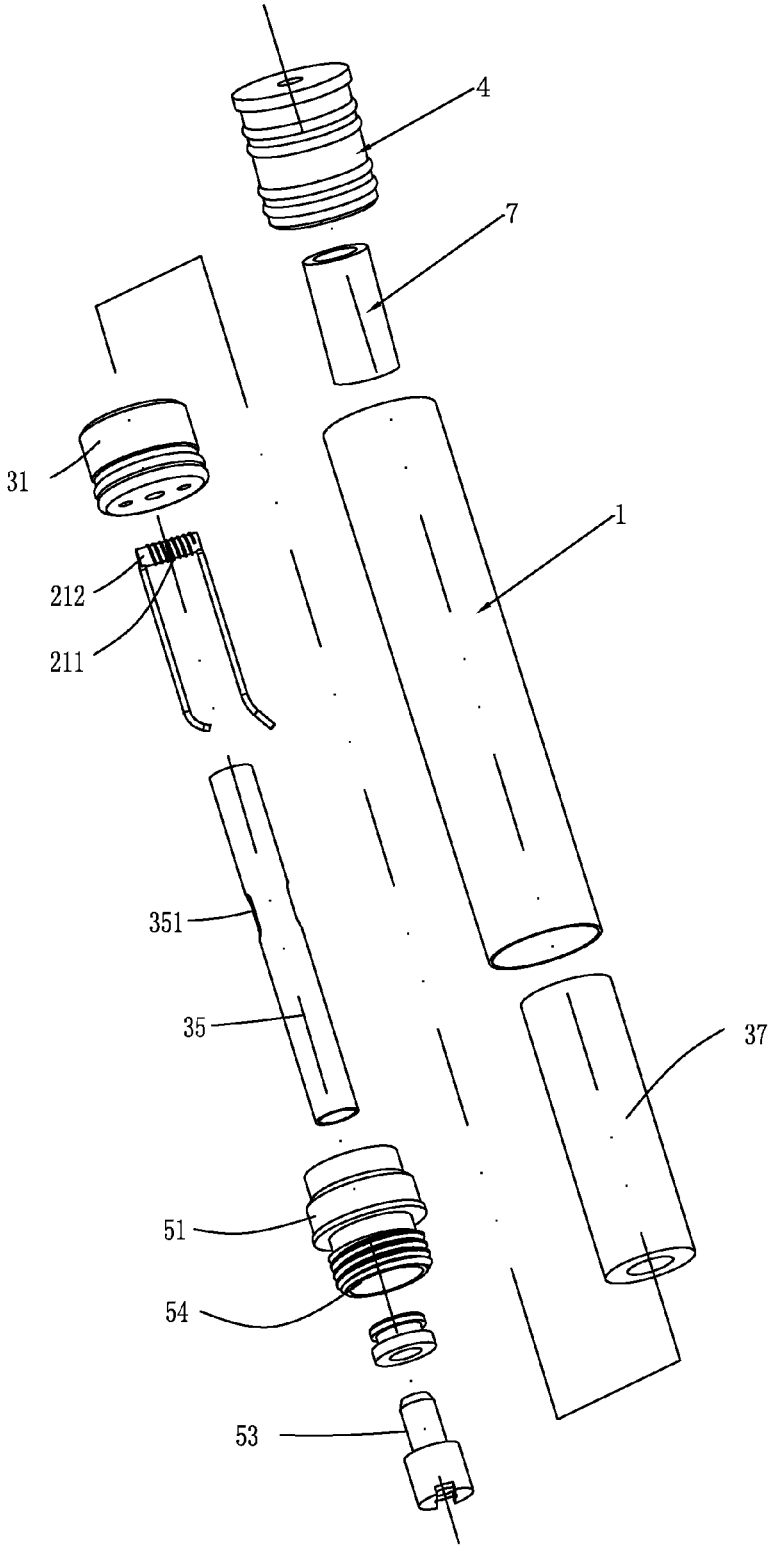
FIG. 4 is an exploded view of the sucking rod of the electronic cigarette in accordance with the first embodiment of the present invention.
Figure 5:
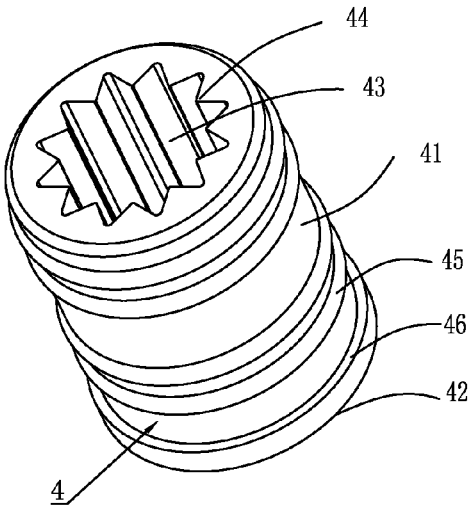
FIG. 5 is an isometric view of a nozzle of the electronic cigarette in accordance with the first embodiment of the present invention.
Figure 6:
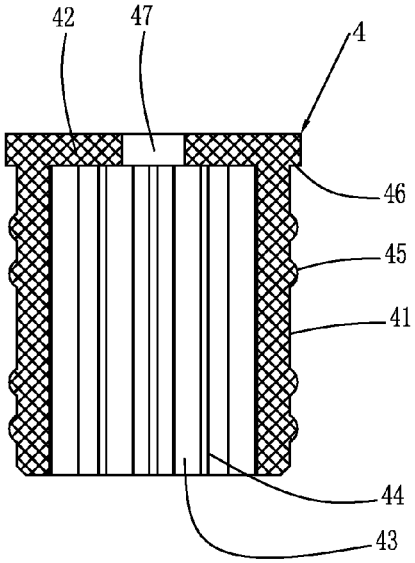
FIG. 6 is a cross-sectional view of the nozzle of the electronic cigarette in accordance with the first embodiment of the present invention.
Figure 7:
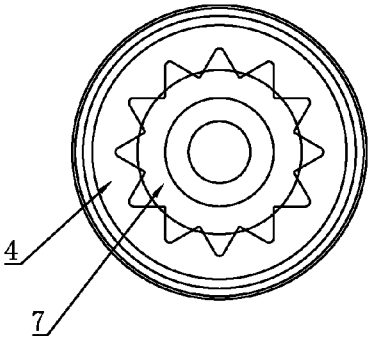
FIG. 7 is a bottom view of an assembly of a support tube and the nozzle of the electronic cigarette in accordance with the first embodiment of the present invention.
Figure 8:
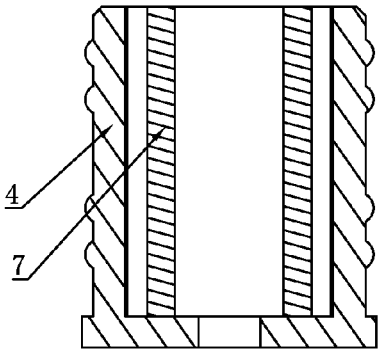
FIG. 8 is a cross-sectional view of the assembly of the support tube and the nozzle of the electronic cigarette in accordance with the first embodiment of the present invention.

As shown in FIG. 2 and FIG. 3, in this embodiment, the electronic cigarette's sucking rod 90 comprises the sucking cylinder 1 with hollow cylindrical structure, an atomizer 2, a liquid smoke cup 3 for reserving liquid smoke, a nozzle 4 and the first connector 5 for connecting with the power rod 91. The nozzle 4 and the first connector 5 are respectively mounted at opposite ends of the sucking cylinder 1, and the atomizer 2 and the liquid smoke cup 3 are disposed in the sucking cylinder.

The atomizer 2 is used for transforming the liquid smoke into smog, and comprises a heating wire 211 and a liquid guiding member 212 for absorbing the liquid smoke and supporting the heating wire 211, the heating wire 211 is wound around the liquid guiding member 212, the liquid guiding member 212 is capable of absorbing and reserving the liquid smoke, and can be made of fiberglass or materials having liquid-absorbent and liquid storage properties such as cotton material. In the embodiment, the liquid guiding member 212 is accommodated and positioned in the liquid smoke cup 3, the heating wire 211 has its opposite ends to pass out of the liquid smoke cup 3 and be electrically connected with positive and negative electrodes of a storage battery. The electronic cigarette 100 is further configured therein with a control circuit board 22 for controlling the atomizer 2 to work and a circuit board holder 23 for accommodating and positioning the control circuit board 22, in this embodiment, the atomizer 2 is configured within the sucking cylinder 1, while the control circuit board 22 and the circuit board holder 23 are disposed in the power rod 91, and the control circuit board 22 is configured with a miniature pneumatic switch to control a conduct of circuit to thereby startup the heating wire 211 in work.

As shown in FIG. 3, in this embodiment, the liquid smoke cup 3 comprises a cup holder 31, the nozzle 4 and a part of the sucking cylinder 1. The liquid smoke cup 3 is configured with a liquid storage component 37 and a conduit 35 therein for the liquid smoke, wherein the cup holder 31 and the nozzle 4 are opposed to each other and separately positioned on an inner wall of the sucking cylinder 1 in a certain distant; the conduit 35 is positioned between the cup holder 31 and the nozzle 4. The liquid storage component 37 is sleeved around the conduit 35 and disposed between the cup holder 31 and the nozzle 4.

As shown in FIG. 3, in this embodiment, the cup holder 31 is a cylindrical cup, and comprises an annular sidewall, a round cup bottom, a positioning post coaxially extended from the cup bottom. Wherein an annular inner chamber is defined between the annular sidewall and the positioning post; a vent in the cup holder is axially extended through the positioning post and the cup bottom; the cup bottom defines two perforations therein extended therethrough for the heating wire 211 to pass through. The cup holder 31 is configured with expanding rings at its annular sidewall for tightly engaging with the sucking cylinder 1 by expansion, the cup holder 31 is tightly engaged by expansion with the inner wall of the sucking cylinder 1 through its annular sidewall and the expanding rings.

As shown from FIG. 3 to FIG. 6, the nozzle 4 has its shape and size to be matched with the inner wall of the sucking cylinder 1, and the nozzle is substantially cylindrical, and comprises a tubular main body 41 and a top cover 42 integrally configured at an end portion of the main body 41, the main body 41 defines a vent 43 axially extended through its inner chamber, with plural reinforcing ribs 44 axially extended on an inner wall of the vent 43, the reinforcing ribs 44 are formed by projecting of the inner wall of the vent 43 toward the axis line, or indenting of the inner wall of the vent 43 departed from the axis line. The plural reinforcing ribs 44 are circumferentially arranged, and the reinforcing ribs 44 have curved, conical or trapezoidal cross-sections, but are not limited to these shapes. The main body 41 is configured with expanding portions 45 at its outer sidewall for tightly engaging with the inner wall of the sucking cylinder 1 by expansion, the expanding portions 45 are plural protrusions, bumps or expanding rings radially outwardly protruded from the outer sidewall of the nozzle, or plural protrusions, bumps or strip-shaped ribs axially extended along the outer sidewall of the nozzle, the expanding portions 45 in this embodiment are expanding rings. The top cover 42 is configured with a restraining flange 46 radially outwardly extended therefrom for abutting against an end portion of the shell, the top cover 42 coaxially defines an intake 47 communicated with the vent thereof, the intake 47 has its diameter smaller than an effective diameter of the vent 43 so that the smokers can smoke more smoothly. The nozzle 4 can be made of soft plastic materials, for example any one of the following materials belonging to plastic material, silicone material or rubber material: ABS、PC、PE、POM、PP、PE、PVC、TPU、TPR、TPE or TPV. Soft plastic material having required hardness is preferred.

As shown in FIG. 3, FIG. 4, FIG. 7 and FIG. 8, to reinforce the strength of the nozzle 4, and prevent the nozzle 4 from being excessively deformed when being squeezed by external force, the nozzle is further configured with a support tube 7 therein, the support tube 7 is inserted into the vent 43, the support tube 7 has its outer sidewall to abut against the plural reinforcing ribs 44 so as to be tightly engaged in the vent 43 by expansion, the support tube 7 defines a through hole therein communicated with the intake 47, and the through hole can have a larger diameter than the intake 47.

The nozzle 4 is inserted into the sucking cylinder 1 and is tightly engaged to the inner wall of the sucking cylinder 1 by expanding through its outer sidewall and the expanding portions 45, since the vent 43 is configured with the reinforcing ribs 44 on its inner wall, to reserve a space for deformation of the nozzle 4, and moreover the support tube 7 is configured in the vent 43, therefore, an excessive deformation of the nozzle 4 inserted into the sucking cylinder 1 can be avoided during being squeezed by an external force, to prevent the nozzle 4 from withstanding an axial extruding force which is larger than a frictional force between nozzle 4 and the sucking cylinder 1, and avoid the nozzle 4 to fall off from the sucking cylinder 1. When the liquid smoke in the liquid smoke cup 3 is exhausted, the nozzle 4 can be taken out to add liquid smoke into the liquid smoke cup 3.

The conduit 35 (see FIG. 3 and FIG. 4) is adapted for supporting the liquid storage component 37, and simultaneously for controlling the height of the liquid smoke cup 3 and supporting the liquid guiding member 212, and further for working as an access of the smog generated by atomizing the liquid smoke via the atomizer 2 to an exterior of the sucking cylinder 1. In this embodiment, the conduit 35 is a hollow round pipe with a central hole, and can be made of plastic or fiber materials, for example fiberglass tube, and comprises a top portion and a bottom portion, the top portion thereof abuts against the nozzle 4, while the bottom portion thereof is sleeved around and circumferentially hermetical with the positioning post of the cup holder 31. The conduit 35 has its central hole to be communicated with the vent of the nozzle and the vent of the cup holder respectively, specifically, the central hole of the conduit 35 is communicated with the through hole of the support tube. The conduit 35 defines locking slots 351 extended through its pipe wall, for supporting and positioning the liquid guiding member 212, the liquid guiding member 212 traverses the conduit 35 and has its opposite ends to pass through the locking slots 351 and abut against the liquid storage component 37 to absorb the liquid smoke for atomization by the heating wire 211.

The liquid storage component 37 (see FIG. 3 and FIG. 4) is adapted for absorbing and storing the liquid smoke injected into the liquid smoke cup 3 for subsequent atomization into smog by the heating wire 211, it can absorb and store the liquid smoke, and can adopt materials having liquid-absorbent and liquid storage properties such as cotton material. The liquid storage component 37 is a hollow cylindrical structure, it is sleeved on an outside of the conduit 35 and tightly engaged with the outer wall of the conduit 35 for support, the conduit 35 has its one end to be inserted and positioned in the annular inner chamber of the cup holder 31, and its another end to abut against the nozzle 4. The liquid storage component 37 has its inner sidewall to further abut against the liquid guiding member 212, the liquid smoke is infiltrated from the liquid storage component 37 into and absorbed by the liquid guiding member 212 and then atomized into smog by the heating wire 211.

As shown in FIG. 2 and FIG. 3, the first connector 5 comprises a first seat 51, a first pole 53 and a first insulating sleeve 54, and the first pole 53 defines a vent in its central portion. The first pole 53 is sleeved and positioned within the first insulating sleeve 54, the first pole 53 is inserted into a central portion of the first seat 51 by means of the first insulating sleeve 54, and the first pole 53 and the first insulating sleeve 54 constitute a first pole component. In this embodiment, the first seat 51 and the first pole 53 are respectively served as two connecting electrodes of the first connector 5. The first seat 51 has its shape matched with the sucking cylinder 1, it is inserted and positioned into the sucking cylinder 1 and abuts against the cup holder 3.

As shown in FIG. 2, the power rod 91 is entirely tubular-shaped, it comprises the sheath 910, and the second connector 6 connected with the first connector 5 is configured at an end of the sheath 910 which is connected with the sucking rod 90, and the sheath 910 is equipped with the storage battery 918 and other components therein. The power rod 91 has its another end to be configured with an end cap 919, and the end cap 919 defines an intake (not shown). The second connector 6 comprises a second seat 61 and a second pole component configured within the second seat 61. The second pole component comprises a second pole 62 and a second insulating sleeve 64 configured between the second seat 61 and the second pole 62 to insulate the first seat 61 and the second pole, the second pole 62 defines a vent coaxially extended therethrough. The second seat 61 and the second pole 62 are respectively connected with corresponding electrodes on the control circuit board 22, while the control circuit board 22 is then connected with the positive and negative electrodes of the storage battery 918.

As shown in FIG. 2, when the first connector 5 of the sucking rod 90 is inserted into the second connector 6 of the power rod 91 in right place, at this time, the first seat 51 is inserted into the second seat 61 and abuts against an end portion of the second seat 61 to conduct the first seat 51 and the second seat 61, while an end portion of the first pole 53 abuts against the second pole 62, to ensure that the first pole 53 and the second pole 62 are in good contact; so it can ensure that the first connector 51 and the second connector 61 are in good contact, to thereby realize corresponding connection of the circuit of the sucking rod 90 with the circuit inside the power rod 91.

In addition, as shown in FIG. 2, external air goes into the power rod 91 from the intake of the end cover 919 located at the bottom of the power rod 91, enters the sucking rod 90 via the vent in the central portion of the second pole 622 and the vent in the central portion of the first pole 53, and then in turn passes by the vent of the cup holder 31 of the liquid smoke cup 3, the central hole of the conduit 35 and the vent of the nozzle 4 or the through hole of the support tube and flows out of the sucking rod 90, to form an air channel inside the electronic cigarette, and keep smooth air-exchange between the electronic cigarette and the exterior. Certainly, external air can also go into the sucking rod 90 directly through the vent of the nozzle 4 and then reach the conduit 35.

Some improvement and modification can be made to the present invention based on the above-described embodiment, for example: the first connector 5 and the second connector 6 can be exchanged; other components can be adjusted accordingly.

Figure 9:
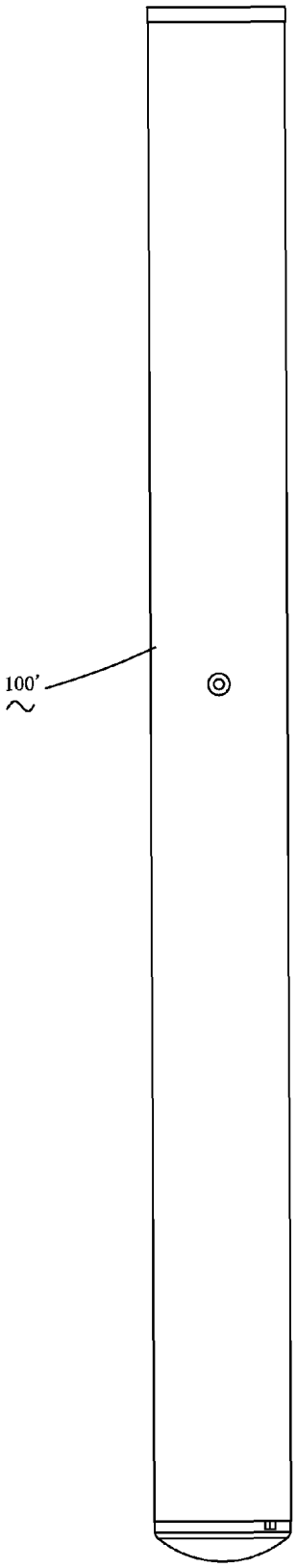
FIG. 9 is a front view of an electronic cigarette in accordance with a second embodiment of the present invention.
Figure 10:
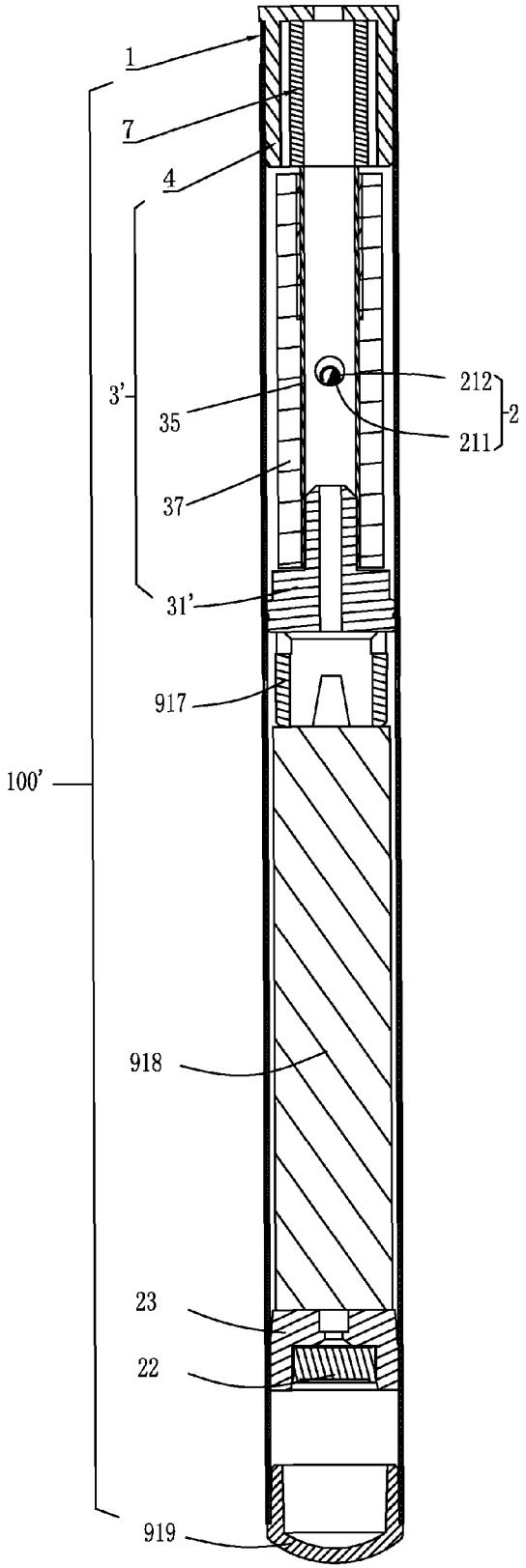
FIG. 10 is a cross-sectional view of the electronic cigarette in accordance with the second embodiment of the present invention.

As shown in FIG. 9 and FIG. 10, a second embodiment of the present invention further provides an electronic cigarette 100', it has a similar internal structure to the electronic cigarette 100 of the first embodiment, but the difference therebetween is that the electronic cigarette 100' is a one-piece electronic cigarette, the electronic cigarette 100' has a one-piece shell, the nozzle 4 is inserted to an inner wall of the shell of the electronic cigarette 100' the nozzle 4 is also configured with the support tube 7, and can also prevent the nozzle 4 from falling off from the shell. The electronic cigarette 100' is also configured with a liquid smoke cup 3' therein similar to the liquid smoke cup 3, and the difference therebetween is that the cup holder 31' of the liquid smoke cup 3' has a more simple structure compared to the cup holder 31. A barrier 917 is configured between the liquid smoke cup 3' and the storage battery 918.

The above-described is embodiments of the present invention, it should be noted that, for the persons of ordinary skill in this field, various changes and improvements within the principle and spirit of the present invention can be made, and the changed and improved solutions also fall into the protecting scope of the present invention.

What is claimed is:

1. An electronic cigarette for preventing its nozzle from falling off, comprising a shell with a hollow inner chamber, the shell being configured with an atomizer, a cylindrical liquid storage component and a storage battery therein, the shell having its one end to be inserted with a cylindrical nozzle, the nozzle coaxially defining a vent extended therethrough, wherein, the nozzle is configured with expanding portions at its outer sidewall for tightly engaging with an inner wall of the shell by expansion, plural reinforcing ribs axially extend on an inner wall of the vent, a support tube is inserted into the vent and positioned on an inner wall of the vent; a cup holder is set in the shell for supporting the liquid storage component; the nozzle, the cup holder and a part of the shell collectively form a liquid smoke cup for accommodating and positioning the liquid storage component, a conduit is fitted in the liquid storage component and is engaged with an inner wall of the liquid storage component for supporting the liquid storage component, the conduit is communicated with the vent of the nozzle;

the nozzle comprises a main body and a top cover at an top end of the main body, and the expanding portions are configured at an outer sidewall of the main body, the vent is defined in the main body and axially extended through the main body, the top cover defines an intake communicated with the vent;

the support tube has its outer sidewall to abut against the plural reinforcing ribs and is tightly engaged with the inner wall of the vent by expansion;

the support tube has its opposite ends to be respectively communicated with the conduit and the intake of the top cover of the nozzle.

2. The electronic cigarette as described in claim 1, wherein, the reinforcing ribs are formed by projecting of the inner wall of the vent toward the axis line, or indenting of the inner wall of the vent departed from the axis line.

3. The electronic cigarette as described in claim 1, wherein, the plural reinforcing ribs are circumferentially arranged.

4. The electronic cigarette as described in claim 1, wherein, the reinforcing ribs have curved, conical or trapezoidal cross-sections.

5. The electronic cigarette as described in claim 1, wherein, the expanding portions are plural protrusions, bumps or expanding rings radially outwardly protruded from the outer sidewall of the nozzle, or plural protrusions, bumps or strip-shaped ribs axially extended along the outer sidewall of the nozzle.

6. The electronic cigarette as described in claim 1, wherein, the main body of the nozzle is tubular, and the top cover is integrally configured at the top end of the main body, the top cover coaxially defines the intake communicated with the vent.

7. The electronic cigarette as described in claim 1, wherein, the top cover is configured with a restraining flange radially outwardly extended therefrom for abutting against an end portion of the shell.

8. The electronic cigarette as described in claim 1, wherein, the intake has its diameter smaller than an effective diameter of the vent.

9. The electronic cigarette as described in claim 1, wherein, the atomizer comprises a heating wire and a liquid guiding member for absorbing the liquid smoke and supporting the heating wire, the heating wire is wound around the liquid guiding member, the cup holder is a cylindrical cup, and the cup holder comprises an annular sidewall, a round cup bottom, a positioning post coaxially extended from the cup bottom; an annular inner chamber is defined between the annular sidewall and the positioning post for accommodating the liquid storage component; a vent in the cup holder is axially extended through the positioning post and the cup bottom; the cup bottom defines perforations therein extended therethrough for the heating wire to pass through; the cup holder is configured with expanding rings at its annular sidewall for tightly engaging with the shell by expansion, the cup holder is tightly engaged by expansion with the inner wall of the shell through its annular sidewall and the expanding rings; the heating wire has its positive and negative electrodes to pass out of the cup holder respectively and be electrically connected with positive and negative electrodes of the storage battery.

10. The electronic cigarette as described in claim 9, wherein, the conduit is a hollow round pipe with a central hole, and comprises a top portion and a bottom portion, the top portion thereof abuts against the nozzle, while the bottom portion thereof is sleeved and positioned on the cup holder; the conduit has its central hole to be communicated with the vent of the nozzle and the vent of the cup holder respectively; the conduit defines locking slots extended through its pipe wall for supporting and positioning the liquid guiding member, the liquid guiding member traverses the conduit and has its opposite ends to pass through the locking slots and abut against the liquid storage component to absorb the liquid smoke for atomization by the heating wire.

11. The electronic cigarette as described in claim 9, wherein, the liquid storage component is a hollow cylindrical structure, and sleeved on an outside of the conduit and tightly engaged with the outer wall of the conduit for support, and has its one end to be inserted into the annular inner chamber of the cup holder, and its another end to abut against the nozzle; the liquid storage component has its inner sidewall to abut against the liquid guiding member.

12. The electronic cigarette as described in claim 9, wherein, the electronic cigarette comprises a sucking rod and a power rod connected with each other, the shell of the electronic cigarette is constituted by a casing of the sucking rod and a casing of the power rod, the nozzle is inserted to an inner wall of the casing of the sucking rod; the sucking rod is configured with a first connector at its end engaged with the power rod, the first connector comprises a first seat and a first pole respectively served as two connecting electrodes of the first connector, a first insulating sleeve is configured between the first seat and the first pole for insulation, the first pole is inserted into a central portion of the first seat by means of the first insulating sleeve; the first seat and the first pole are respectively connected with the positive and negative electrodes of the heating wire, the power rod is configured with a second connector at its end engaged with the sucking rod, the second connector comprises a second seat and a second pole respectively served as two connecting electrodes of the second connector, a second insulating sleeve is configured between the second seat and the second pole for insulation, the second pole is inserted into a central portion of the second seat by means of the second insulating sleeve, the storage battery is configured in the power rod, the second seat and the second pole are respectively connected with the positive and negative electrodes of the storage battery; the first seat and the second seat are threadedly connected to make the first seat and the second seat to abut against each other and make the first pole and the second pole to abut against each other.

13. The electronic cigarette as described in claim 9, wherein, the electronic cigarette is a one-piece electronic cigarette, and its shell is a one-piece shell.

14. The electronic cigarette as described in claim 1, wherein, the nozzle is made of soft plastic materials, silicone material or rubber material.

15. The electronic cigarette as described in claim 14, wherein, the soft plastic material is ABS, PC, PE, POM, PP, PE, PVC, TPU, TPR, TPE or TPV.

* * * * *